US005289931A

United States Patent [19]

Doi, deceased

[11] Patent Number: 5,289,931

[45] Date of Patent: Mar. 1, 1994

[54] PILFER-PROOF SYNTHETIC RESIN CAP

[75] Inventor: Kouichi Doi, deceased, late of Kanagawa, Japan, by Eiko Doi and Kenichi Doi, Legal Representatives

[73] Assignee: Japan Crown Cork Co., Ltd., Tokyo, Japan

[21] Appl. No.: 101,267

[22] Filed: Jul. 26, 1993

Related U.S. Application Data

[63] Continuation of Ser. No. 865,121, Apr. 8, 1992, abandoned.

[30] Foreign Application Priority Data

Apr. 8, 1991 [JP] Japan ..... 3-075192

[51] Int. Cl.[5] ..... B65D 41/34

[52] U.S. Cl. ..... 215/252

[58] Field of Search ..... 215/252, 254, 256, 258; 220/276

[56] References Cited

U.S. PATENT DOCUMENTS

| | | | |
|---|---|---|---|
| 3,335,923 | 8/1967 | Healy | 220/288 |
| 4,418,828 | 12/1983 | Wilde et al. | 215/252 |
| 4,635,808 | 1/1987 | Nolan | 215/252 |
| 4,709,824 | 12/1987 | Thompson | 215/252 |
| 4,938,370 | 7/1990 | McBride | 215/252 |
| 5,004,112 | 4/1991 | McBride | 215/252 |

FOREIGN PATENT DOCUMENTS

| | | |
|---|---|---|
| 0381118 | 8/1990 | European Pat. Off. . |
| WO8703561 | 6/1987 | World Int. Prop. O. . |

*Primary Examiner*—Allan N. Shoap
*Assistant Examiner*—Nova Stucker
*Attorney, Agent, or Firm*—Sughrue, Mion, Zinn, Macpeak & Seas

[57] ABSTRACT

A cap has a circumferential band with flap pieces formed at the lower end of a cylindrical skirt portion via a weakened portion, and a feature resides in a circumferential curled portion that is formed at the lower end of the circumferential band. When the cap is opened, the flap pieces effectively prevents the circumferential band from entirely escaping.

2 Claims, 2 Drawing Sheets

PILFER-PROOF SYNTHETIC RESIN CAP

This is a continuation of application Ser. No. 07/865,121 filed Apr. 8, 1992, now abandoned.

BACKGROUND OF THE INVENTION

1. Field of the Invention

The present invention relates to a pilfer-proof synthetic resin cap.

2. Description of the Prior Art

A pilfer-proof synthetic resin cap has heretofore been known to have a top panel, a cylindrical skirt portion hung from the peripheral edge of the top panel, a circumferential band provided at the lower end of the cylindrical skirt portion via a weakened line, and flap pieces provided maintaining a predetermined distance on the inner surface of the circumferential band portion to engage with a jaw portion formed at the mouth of a container, and has been widely put into practical use.

With this cap, the circumferential band portion is secured by the flap pieces to the mouth of the container. When the cap is opened, therefore, the weakened line is broken and the circumferential band portion only remains at the mouth of the container to exhibit a pilfer-proof function.

In the above cap, however, the flap pieces are not strong enough to fully engage the jaw portion formed at the mouth of the container and, besides, the weakened line is frequently not broken even when the cap is open; i.e., the cap is often entirely removed together with the circumferential band.

Furthermore, some gap is formed between the lower end of the circumferential band and the mouth of the container, and mischief is often done using this gap.

Japanese Laid-Open Patent Publication No. 296666/1990 discloses a cap having an upwardly directed flexible tab formed on the circumferential band portion and interference beads formed at the lower end of the circumferential band to inwardly protrude.

In the cap of the above prior art, an increased engaging force is obtained between the circumferential band and the jaw portion formed at the mouth of the container due to the flexible tab and the interference beads that work in cooperation together. Therefore, the cap that is opened is effectively prevented from being entirely removed, and the gap formed between the lower end of the circumferential band and the mouth of the container is filled with the interference beads. According to the above prior art, however, the cap is molded very difficulty since it has two kinds of protrusions, i.e., flexible tab and interference beads on the inside of the circumferential band. That is, the caps of this type are usually produced by such molding means as injection molding using a suitable metal mold. In the case of the above cap, however, is very difficult to remove the, metal mold after the molding operation because of the shape of the circumferential band portion. In fact, the above prior art does not at all describe concerning the molding means.

SUMMARY OF THE INVENTION

The object of the present invention, therefore, is to provide a pilfer-proof synthetic resin cap that can be formed very easily, that is effectively prevented from entirely escaping at the time it is opened, and that effectively prevents tampering that may be utilizing the gap formed between the lower end of the circumferential band and the mouth of the container.

According to the present invention, there is provided a pilfer-proof synthetic resin cap comprising a top panel, a cylindrical skirt portion hung from the peripheral edge of the top panel, a circumferential band provided at the lower end of the cylindrical skirt portion via a weakened line, and flat pieces provided maintaining a predetermined distance on the inner surface of the circumferential band portion to engage with the jaw portion formed at the mouth of a container, wherein a circumferential curled portion that is inwardly curled is formed at the lower end of the circumferential band.

According to the present invention, a distinguished feature resides in an inwardly directed circumferential curled portion that is formed at the lower end of the circumferential band. The circumferential curled portion reinforces the engaging force between the flap pieces and the jaw portion at the mouth of the container and helps effectively avoid the circumferential band from entirely escaping when the cap is opened.

Further, the gap formed between the lower end of the circumferential band and the container is filled with the circumferential curled portion, contributing to effectively preventing mischievous deeds that may be done by using the gap.

According to the present invention, furthermore, when the cap under the closed condition is turned, the weakened line starts breaking with a small angle of turn of the cap since the engaging force has been reinforced between the flap pieces and the jaw portion at the mouth of the container. As will become obvious from the Example and Comparative Example appearing later, the above-mentioned angle of turn is about 200 degrees in the case of the cap of the present invention whereas the above angle of turn is about 360 degrees in the case of the conventional cap without having the circumferential curled portion which is much greater than that of the cap of the present invention. A large angle of turn means that the weakened line is not broken even when the cap is turn to such a degree that the sealing of cap is broken, which is quite undesirable from the standpoint of preventing mischief. On the other hand, a small angle of turn accomplished by the present invention as described above means that the weakened line breaks when the cap is rotated to such a degree that the sealing of portion the cap is broken; i.e., breakage of the sealing portion of cap is revealed to the general consumers enabling mischievous deeds to be prevented in advance.

In the cap of the present invention in which the flap pieces are protected by the circumferential curled portion, furthermore, the flap pieces are effectively prevented from being deformed during the period of from when the cap is molded until when the cap is tightly fitted to the mouth of the container, which is an additional advantage of the present invention.

In the present invention mentioned above, the circumferential curled portion can be formed easily. For example, a cap provided, via a weakened line, with a circumferential band having flap pieces is molded by the injection molding, and then a circumferential cured portion is formed at the lower end of the circumferential band relying on a very simple means.

DETAILED DESCRIPTION OF THE INVENTION

The invention will now be described in detail by way of an embodiment shown in the accompanying drawings.

Figure 1:
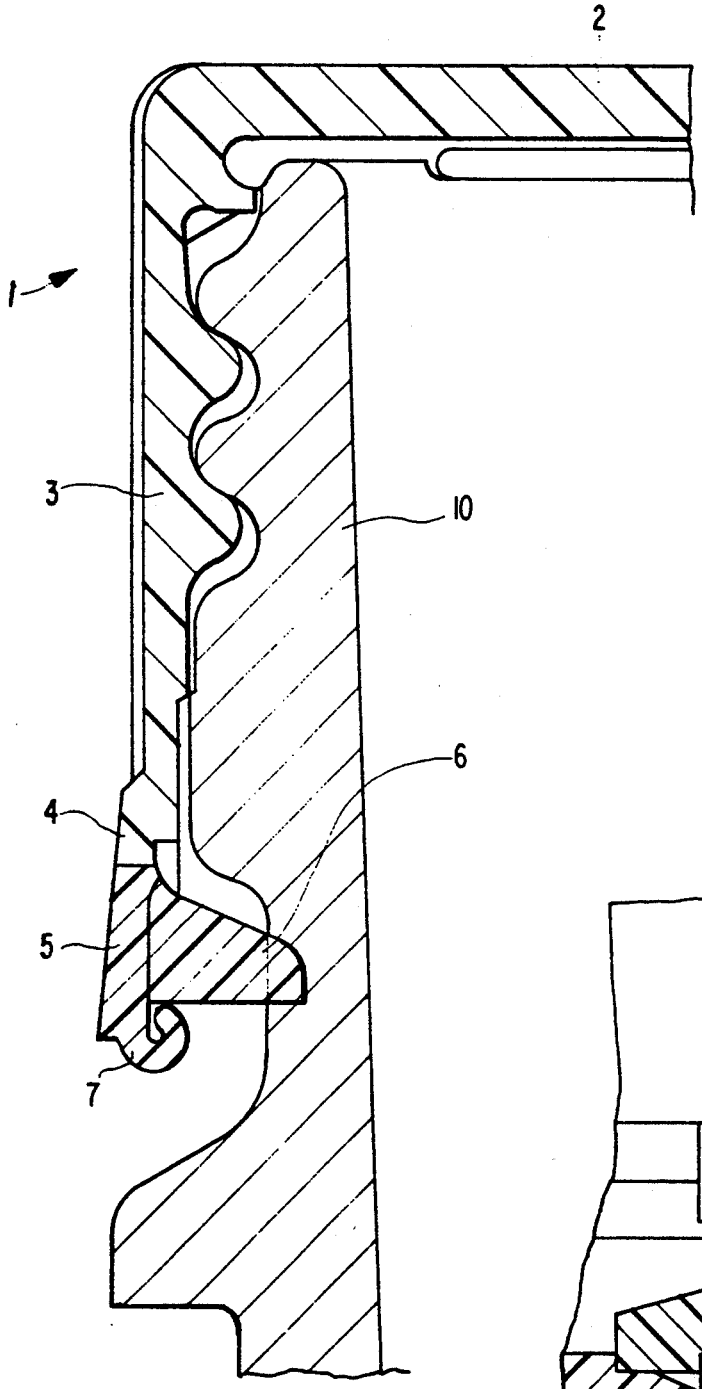
FIG. 1 is a diagram showing the condition where the cap of the present invention is fitted to the mouth of a container.

FIG. 1 shows the condition where the cap of the present invention is fitted to the mouth of the container. In FIG. 1, the cap (designated generally at 1) has a cylindrical skirt portion 3 hung from the peripheral edge of a top panel. A circumferential band 5 is provided at the lower end of the skirt portion 3 via a weakened line 4.

Flap pieces 6 are provided maintaining a predetermined distance on the inner surface of the circumferential band 5. Each flap piece 6 is oriented in the same direction as the direction in which the cap 1 is opened. That is, as the cap is turned so as to be opened, the flap pieces 6 come in contact with the lower side of a jaw portion 10 of the container, whereby a great resistance force acts upon opening the cap, the weakened line 4 is broken, and the circumferential band 5 is left at the mouth of the container.

According to the present invention, a circumferential curled portion 7 is formed at the lower end of the circumferential band 5. That is, when the cap is being opened and the flap pieces 6 come into contact with the lower side of the jaw portion 10 of the container, the circumferential curled portion 7 works to push the flap pieces 6 from the lower side of the jaw portion 10, so that the flap pieces 6 are effectively prevented from being elongated or deformed. Therefore, resistance force is reinforced against opening the cap, and the circumferential band 5 is effectively prevented from entirely escaping at the time of opening the cap.

As is obvious from FIG. 1, furthermore, the circumferential curled portion 7 that is formed makes narrow the gap between the lower end of the circumferential band 5 and the wall of mouth of the container, contributing to effectively preventing any mischievous deed that may be done by utilizing the gap.

Figure 2:
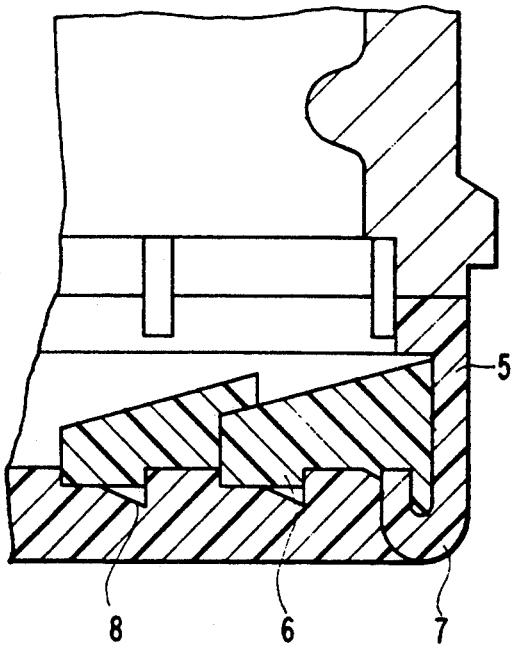
FIG. 2 is a diagram showing a preferred embodiment of the cap of the present invention.

According to the present invention as shown in FIG. 2, furthermore, notches 8 are formed maintaining a predetermined distance at the tip of the circumferential curled portion 7 so as to be corresponded to the flap pieces 6, such that the flap pieces 6 engage with the notches 8. That is, according to this embodiment, the flap pieces 6 are fixed in positions to some extent by the notches 8, and produce further increased resistance force in the direction of opening the cap.

Figure 3:
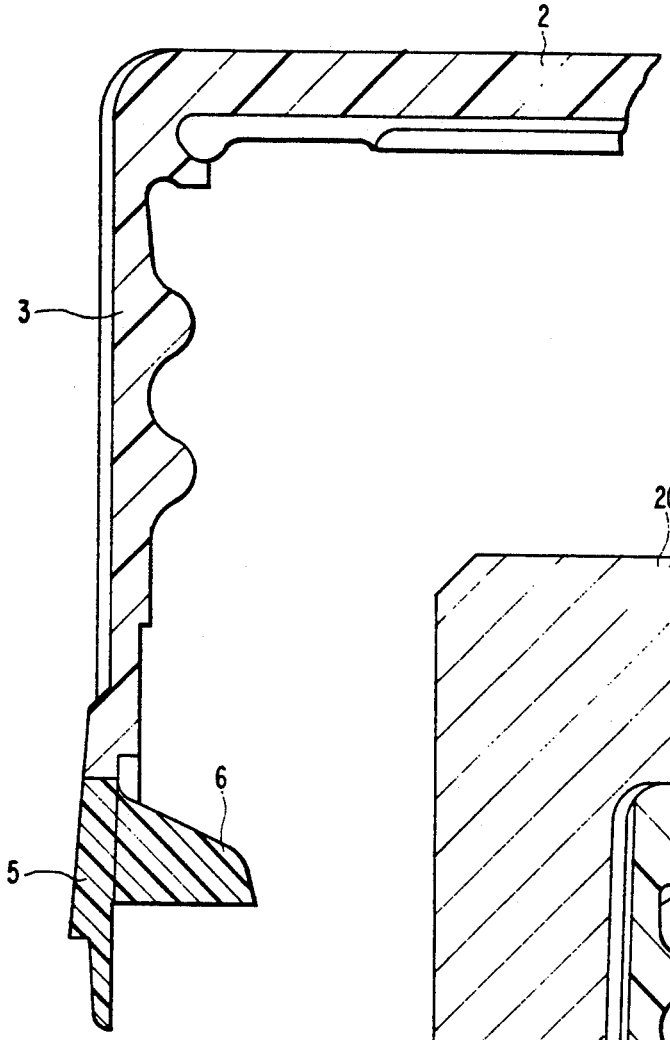
FIG. 3 is a diagram showing the condition where no peripheral curled portion is formed in the cap of the present invention.

The above-mentioned cap of the present invention has an advantage in that it can be formed very easily. That is, the cap without circumferential curled portion 7 is formed by a widely known molding means such as injection molding as shown in FIG. 3 from which it is obvious that the lower portion of the circumferential band portion 5 (lower portion of the flap pieces 6) of the cap is substantially flat. Therefore, the cap is removed from the metal mold without any difficulty and is molded easily.

Figure 4:
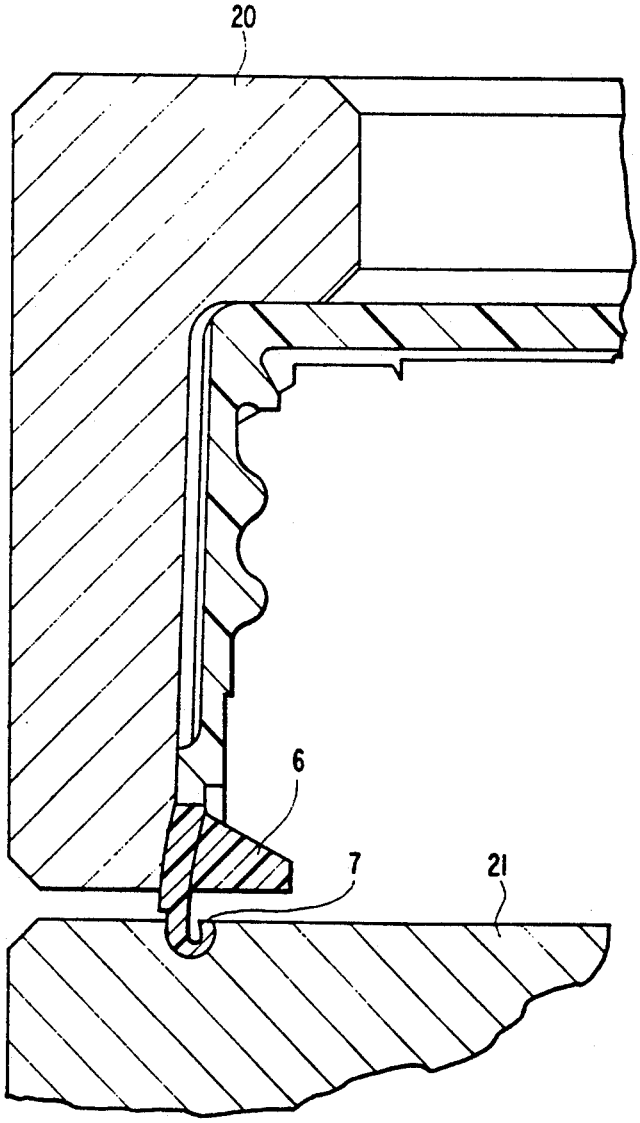
FIG. 4 is a diagram illustrating means for forming the peripheral curled portion.

The cap is then secured in a cap-receiving dies 20 as shown in FIG. 4, and is punched using a punch 21 that is heated at a suitable temperature by a heater or the like, thereby to obtain the cap having the circumferential curled portion 7 formed at the lower end of the circumferential band 5 as contemplated by the present invention.

EXAMPLE 1

A cap (20.4 mm in height of cap and 29.8 mm in outer diameter of cap) of a shape shown in FIG. 1 was molded using a polypropylene resin having a density of 0.912 g/cm$^3$ and a melt flow rate (230° C.) of 10 g/$^{10}$ min.

The cap was tightly fitted to a 1500 ml polyethylene terephthalate bottle. Under this condition, the angle of turn of the cap at which the weakened line starts breaking was measured. Moreover, a cap without the weaking line was molded in the same manner as described above, and was tightly fitted to the above-mentioned bottle to measure a torque with which the cap entirely escapes from the bottle. The results were as shown in Table 1. Measured values are averages of ten samples of each of them.

COMPARATIVE EXAMPLE 1

A cap (19.1 mm in height of cap and 29.8 mm in outer diameter of cap) was molded in the same manner as in Example 1 but without forming the circumferential curled portion, and the torque with which it entirely escapes and the angle of turn at which the weakened line breaks were measured. The results are shown in Table 1.

TABLE 1

| | Torque at which the cap entirely escapes (Kgfcm) | Angle of turn at which the weakened line breaks (degrees) |
|---|---|---|
| Example 1 | 5.74 | 203 |
| Comparative Example 1 | 4.68 | 359 |

It is claimed:

1. A pilfer-proof synthetic resin cap comprising a tap panel, a cylindrical skirt portion hung from the peripheral edge of the top panel, a circumferential band provided at the lower end of said cylindrical skirt portion via a weakened line, and inwardly projecting flap pieces provided on an inner surface of said circumferential band portion to engage a jaw portion formed at the mouth of a container, wherein at a lower end of said circumferential band, a circumferential curled portion that is inwardly curled is formed by a curling process after the formation of the flap pieces.

2. A synthetic resin cap according to claim 1, wherein notches are formed at a tip of said circumferential curled portion, and said flap pieces engage said notches.

* * * * *